US007661934B2

(12) United States Patent
Huang

(10) Patent No.: US 7,661,934 B2
(45) Date of Patent: Feb. 16, 2010

(54) UNIVERSAL AIR PUMP

(76) Inventor: Ying-Che Huang, NO. 111, Lane Tzeng-Fu, Tzeng-Tsuo Tsuen, Shiou-Shuei Shiang, Chang-Hua Hsien, 504 (TW)

( * ) Notice: Subject to any disclaimer, the term of this patent is extended or adjusted under 35 U.S.C. 154(b) by 587 days.

(21) Appl. No.: 11/512,142

(22) Filed: Aug. 30, 2006

(65) Prior Publication Data

US 2008/0056922 A1 Mar. 6, 2008

(51) Int. Cl.
*F04B 33/00* (2006.01)

(52) U.S. Cl. ..... 417/440

(58) Field of Classification Search ..... 417/440, 417/481, 557

See application file for complete search history.

(56) References Cited

U.S. PATENT DOCUMENTS 1,447,963 A * 3/1923 Coleman ..... 417/569
1,491,388 A * 4/1924 Foster ..... 417/468
1,511,971 A * 10/1924 Hunter ..... 417/254
6,485,264 B1 * 11/2002 Wu ..... 417/63
7,032,613 B2 * 4/2006 Delorme ..... 137/231
2004/0086404 A1 * 5/2004 Wu ..... 417/440
2005/0129544 A1 * 6/2005 Wu ..... 417/440
2005/0173451 A1 * 8/2005 Tsutsui ..... 222/3
2006/0060672 A1 * 3/2006 Wang ..... 239/526
2006/0119066 A1 * 6/2006 Chuang ..... 280/201

* cited by examiner

*Primary Examiner*—Devon C Kramer
*Assistant Examiner*—Bryan Lettman
(74) *Attorney, Agent, or Firm*—Rabin & Berdo, P.C.

(57) ABSTRACT

A universal air pump includes a pump; a head mounted to the pump and having a central hole and an air inlet at a side wall thereof; a cylindrical block pivotably fitted in the central hole of the head and having a central chamber, an annular channel on an outer surface thereof, which faces to the air inlet of the head, and at least one air hole defined through an underside of the annular channel and communicating with the central chamber; a fixing seat having a stub tube engaged with the central chamber of the cylindrical block, and an axially-extended through hole communicating with the central chamber; and an air delivery tube mounted to the fixing seat and communicating with the axially-extended through hole. Thus the air delivery tube can rotate relative to the head so as to allow the air pump to be operated at any angle.

9 Claims, 6 Drawing Sheets

UNIVERSAL AIR PUMP

BACKGROUND OF THE INVENTION

1. Field of the Invention

The present invention relates generally to an air pump for pumping air into tires or other objects to be inflated, and in particular to an air pump, an air delivery tube of which can rotate relative to a head of the air pump at any angle for inflation.

2. The Prior Arts

A conventional air pump generally includes a pump, a head mounted to the pump, and an air delivery tube connected to the head at one end thereof. The other end of the air delivery tube connects with an inflating nozzle. When an object such as a tire is to be inflated, the inflating nozzle is coupled to an air tap of the object. Compressed air produced by operating the air pump is then inflated into the object through the head and the air delivery tube.

In general, the air delivery tube of the conventional air pump is fixedly connected to the head. For example, a joint is provided on one end of the air delivery tube, and is screwed on the head; in other words, the head and the air delivery tube cannot rotate relative to each other. Consequently, when the operating space is somewhat narrower, it is difficult to change the operation angle of inflation, thereby causing inconveniences for operating the conventional air pump.

SUMMARY OF THE INVENTION

A primary objective of the present invention is to provide a universal air pump, an air delivery tube of which can rotate relative to a head of the air pump; thereby users enable to operate it at any angle.

To achieve the above-mentioned objective, a universal air pump in accordance with an aspect of the present invention comprises a head having a central hole and an air inlet at a side wall of the head, which communicates with the central hole; a pump mounted to the side wall of the head, wherein a one-way valve facing to the air inlet of the head is disposed between the pump and the head; a cylindrical block having a central chamber extended axially from a first end to a second end thereof, wherein the cylindrical block has an annular channel and seal rings disposed at both sides of the annular channel on an outer surface thereof, at least one air hole is defined through an underside of the annular channel, which communicates with the central chamber, the cylindrical block is pivotably fitted in the central hole of the head and the annular channel faces to the air inlet of the head; a fixing seat having a stub tube, which is protruded from an outer surface of the fixing seating and engaged with the central chamber of the cylindrical block and has an axially-extended through hole communicating with the central chamber; the fixing seat having a side hole provided at a side wall thereof, which communicates with the axially-extended through hole; and an air delivery tube, a first end of which is provided with a joint mounted to the side hole of the fixing seat, and a second end of which is provided with an inflating nozzle. The stub tube is fixed to the cylindrical block and the cylindrical block can rotate 360 degrees in the central hole of the head; thereby the fixing seat together with the air delivery tube can also rotate 360 degrees with the cylindrical block according to user's operation desires.

In accordance with another aspect of the present invention, a pressure gauge is disposed at the second end of the cylindrical block for detecting pressure, and a connection hole is defined through an end surface of the central chamber and communicates the central chamber with the pressure gauge.

In accordance with a further aspect of the present invention, an axle hole is defined through another side wall of the fixing seat, which faces to the side hole. A pressure-releasing device is disposed in the axle hole. The pressure-releasing device comprises an axle pin having a radially discharging hole and a flange disposed at a second end of the axle pin. The axle pin is loosely fitted into the axle hole of the fixing seat. A spring is provided between the second end of the axle pin and the joint. An end of the axle hole is provided with a seal ring, and the flange closely biases against the seal ring due to the action of the spring. The pressure-releasing device can be selectively operated to release the overpressure air in the inflated object via the radially discharging hole.

Compared with conventional air pumps, the air delivery tube of the universal air pump in accordance with the present invention can rotate 360 degrees relative to the head. Accordingly, users can adjust the operation angle of the air delivery tube according to user's desires. It is convenient for users to operate especially in a narrow space.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
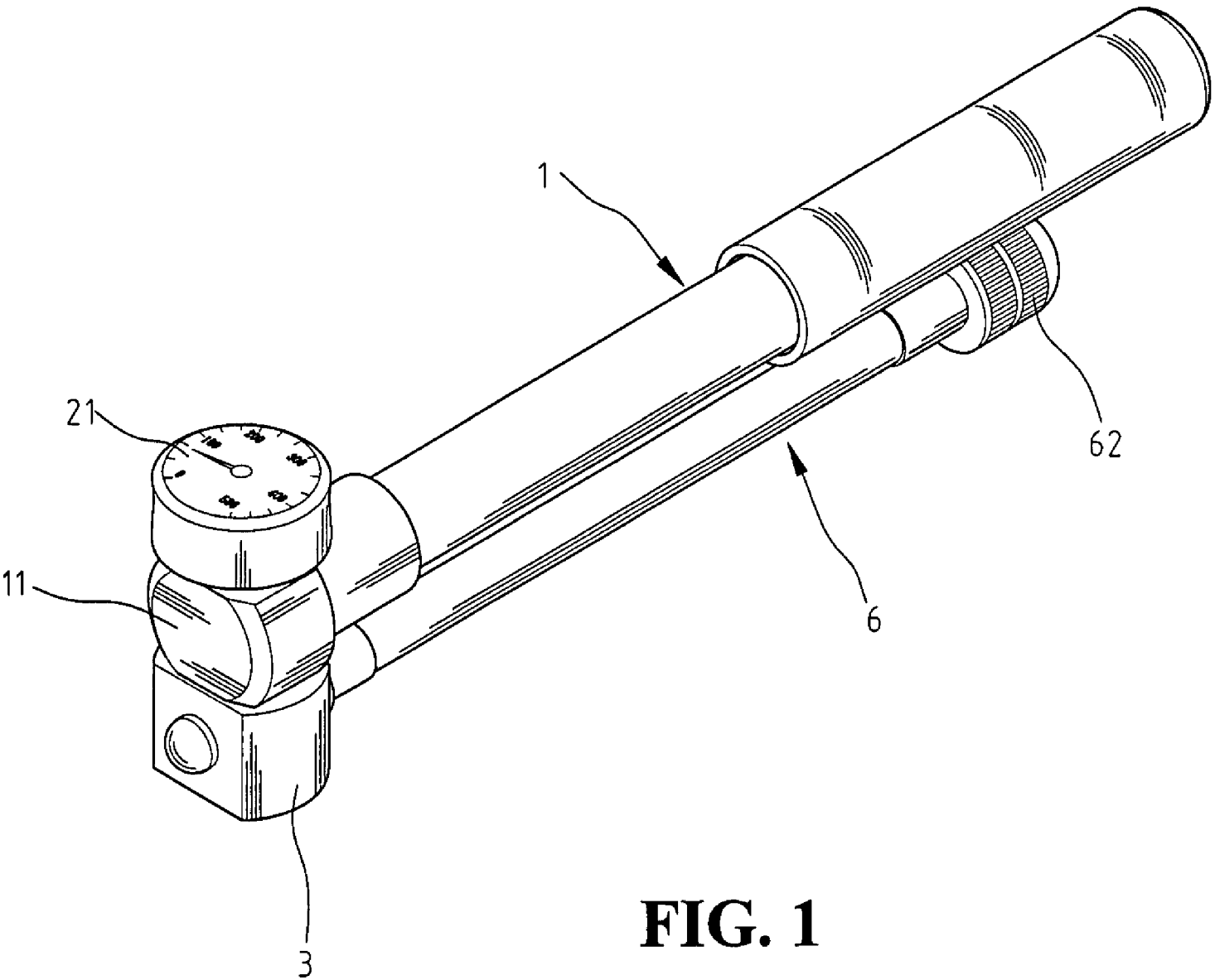
FIG. 1 is a perspective view of an air pump in accordance with the present invention, showing that the air pump is in a folded state.
Figure 2:
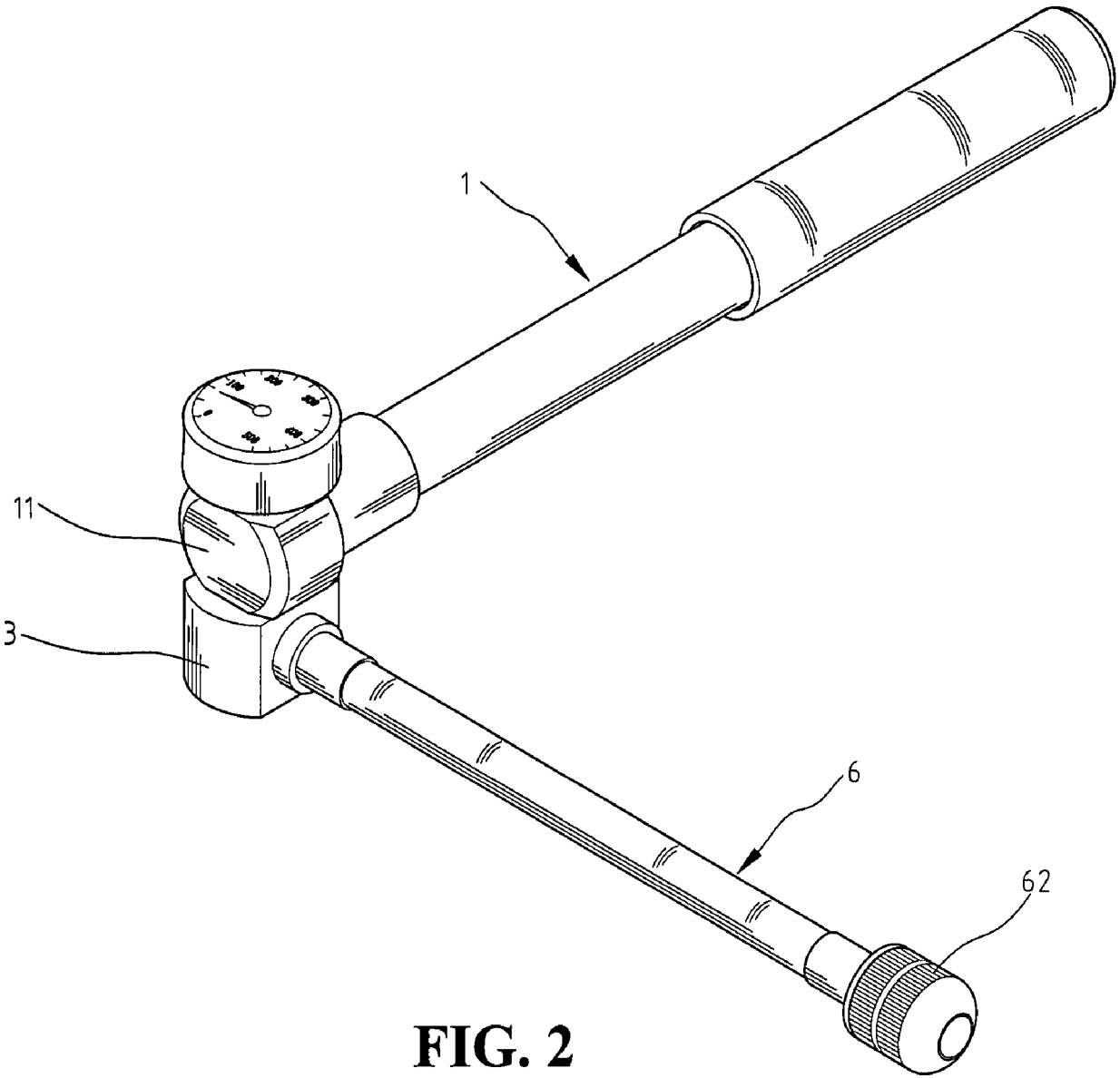
FIG. 2 shows the air pump of FIG. 1, wherein an air delivery tube is rotated 90 degrees relative to a head.
Figure 3:
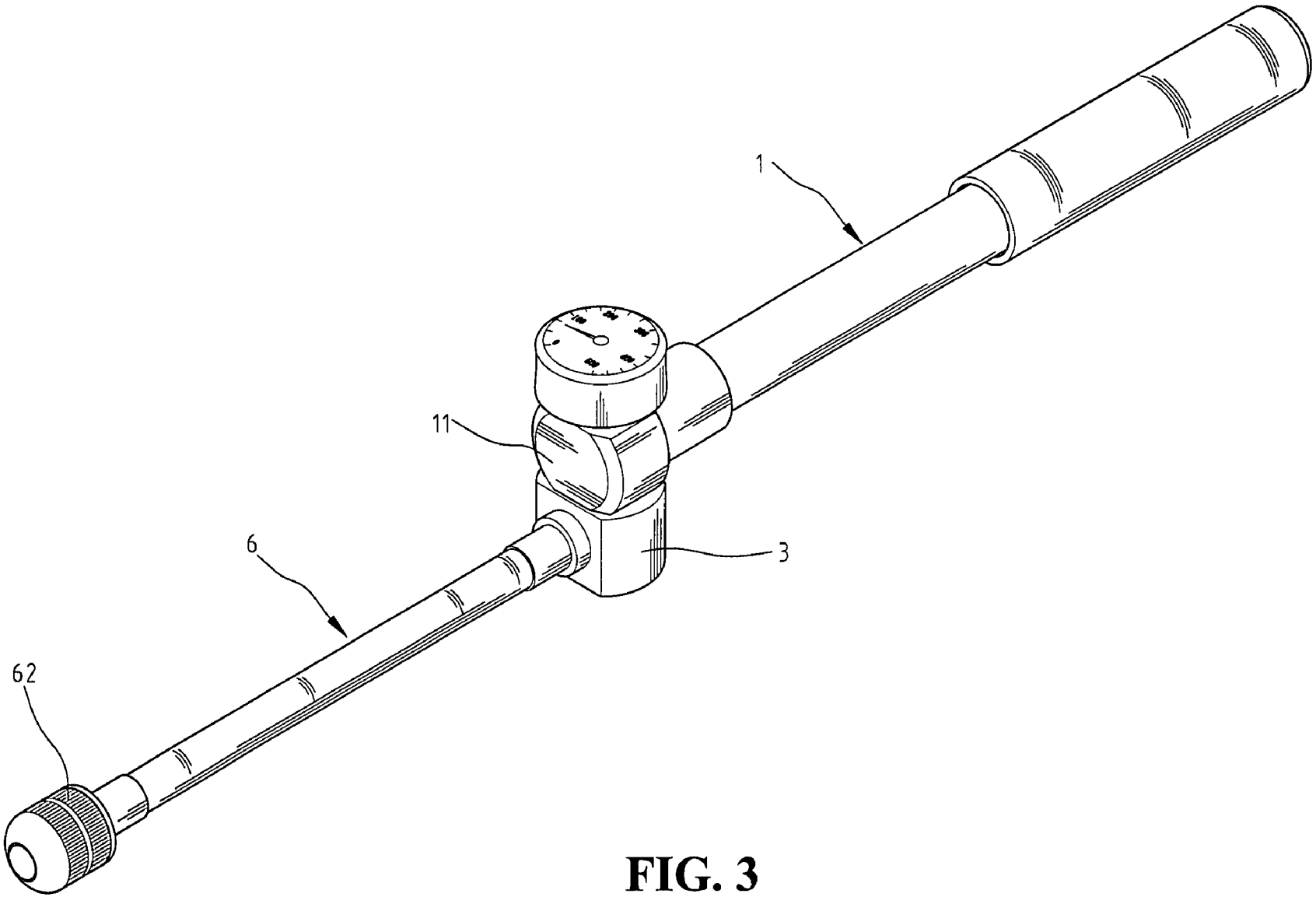
FIG. 3 shows the air pump of FIG. 1, wherein the air delivery tube is rotated 180 degrees relative to the head.

With reference to the drawings and in particular to FIGS. 1-3, a universal air pump in accordance with the present invention comprises a pump 1, a head 11 mounted to one end of the pump 1, and a pressure gauge 21 and a fixing seat 3 mounted at an upper part and an lower part of the head 11, respectively. The fixing seat 3 connects with an air delivery tube 6 which is further provided with an inflating nozzle 62 at one end thereof. The inflating nozzle 62 can be coupled to an air tap of an object to be inflated, and then the pump 1 can be operated to pump air into the object. FIGS. 1-3 also show that the fixing seat 3 can be rotated relative to the head 11, whereby the operation angle of the air delivery tube 6 can be adjusted according to the desires.

Figure 4:
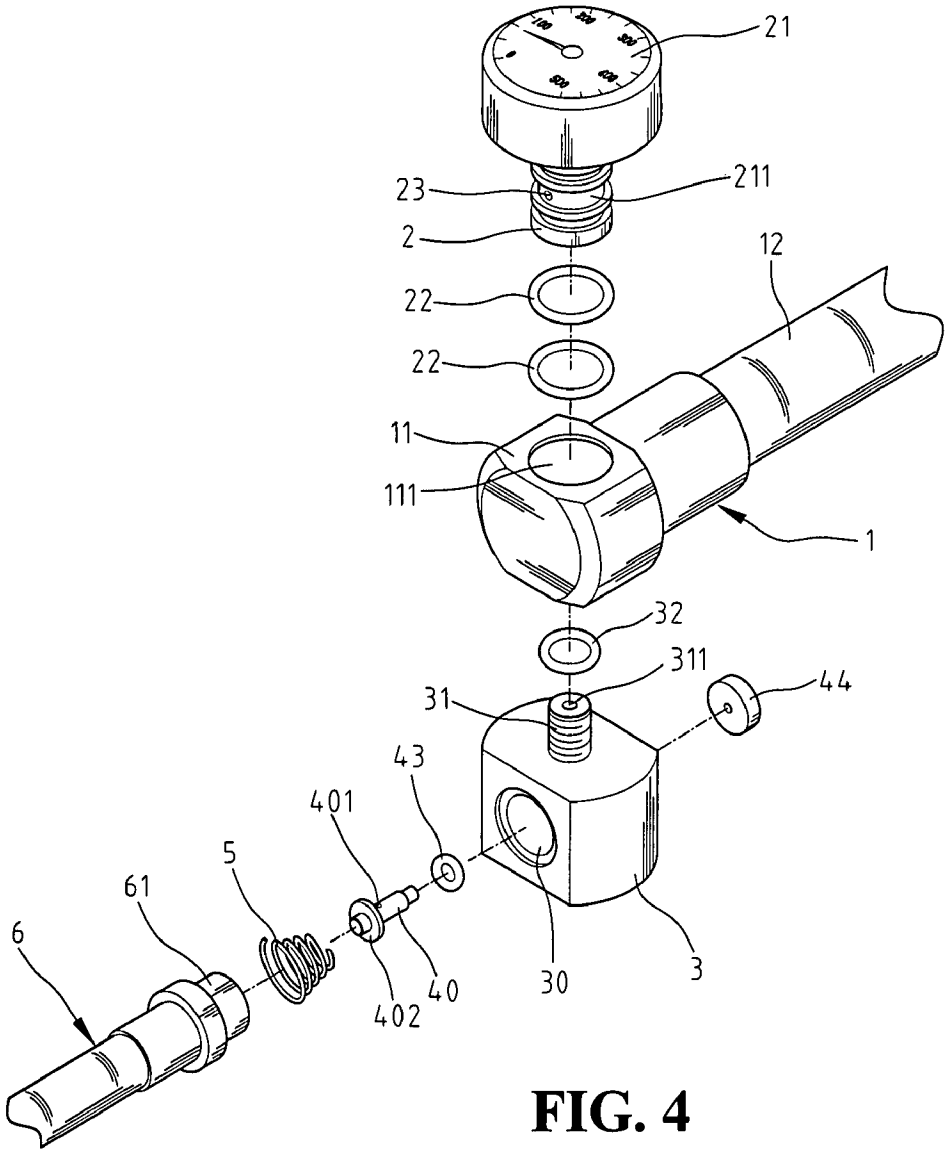
FIG. 4 is a perspective exploded view showing the assembly relationship of main parts of the air pump of the present invention.
Figure 5:
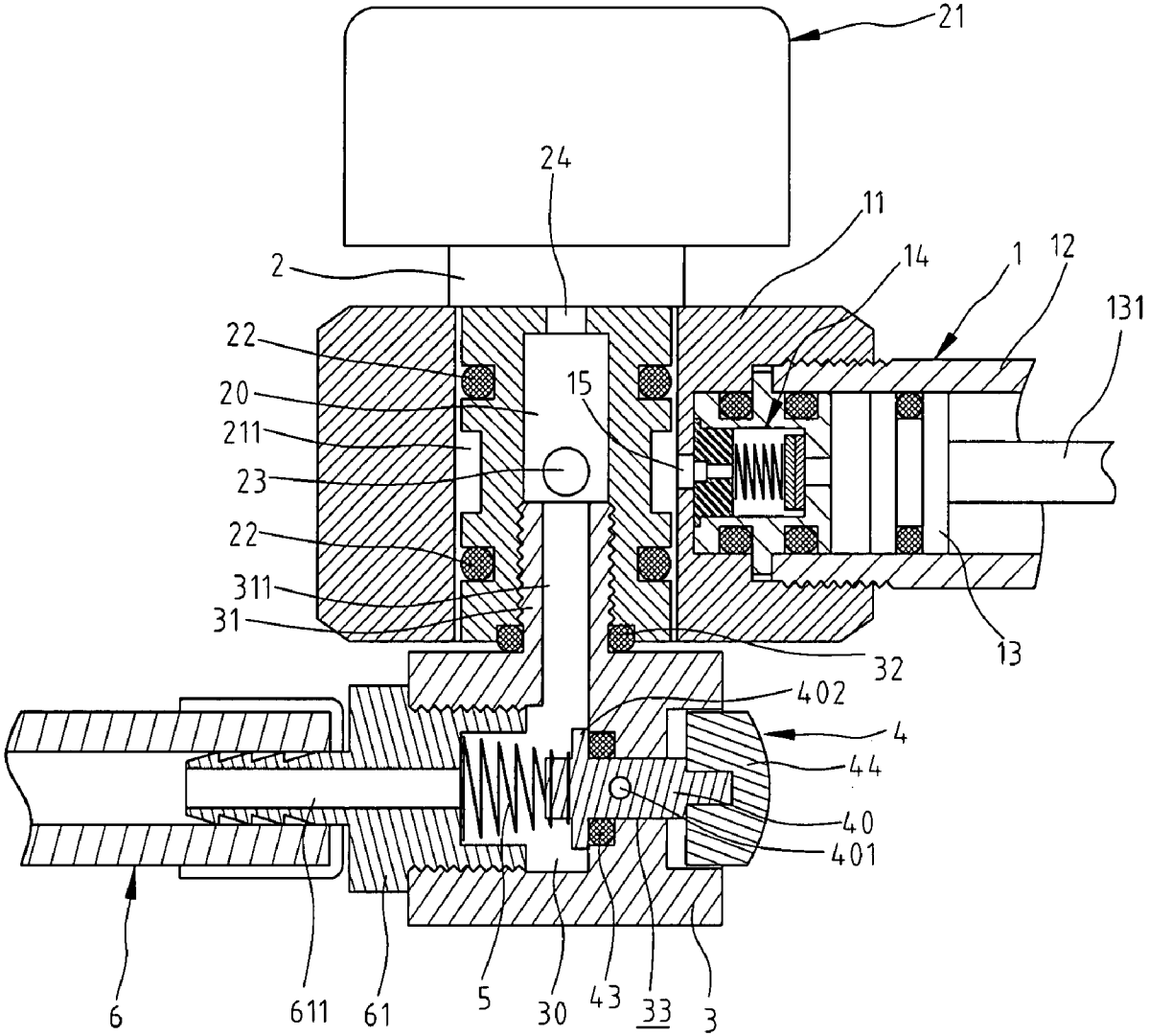
FIG. 5 is a sectional view showing the structure of the air pump in accordance with the present invention.
Figure 6:
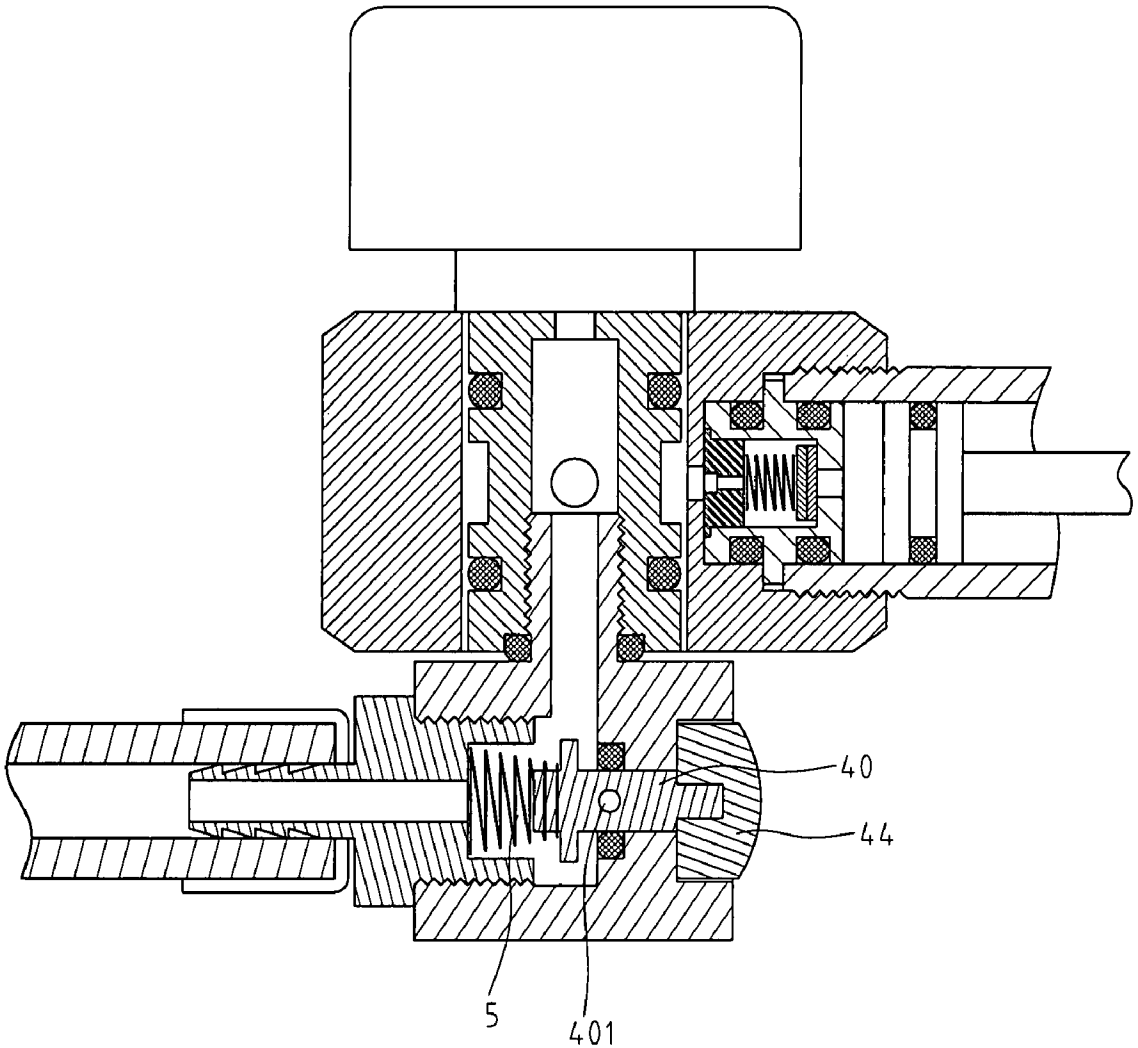
FIG. 6 is a sectional view showing that a pressure-releasing device in accordance with the present invention is operated.

Also referring to FIGS. 4 and 5, a cylindrical block 2 and the fixing seat 3 are mounted in and at the lower end of the head 11, respectively. The head 11 has a central hole 111 and an air inlet 15 that is disposed at a side wall of the head 11 and communicates with the central hole 111. The head 11 is screwed to a cylinder 12 of the pump 1 at the side wall thereof. The cylinder 12 has a piston 13 therein which is linked with a piston rod 131. The head 11 has a one-way valve 14, which faces to the air inlet 15, disposed between the cylinder 12 and the air inlet 15. When a user operates the pump 1 to make the piston rod 131 linked with the piston 13 move toward the air inlet 15, compressed air produced pushes the one-way valve 14 and flows through the air inlet 15. On the contrary, when the piston rod 131 linked with the piston 13 moves backward from the air inlet 15, the one-way valve 14 is closed automatically to avoid the air flowing back from the air inlet 15. The structure of the one-way valve 14 is not a key of the present invention, so its detailed description will not be recited herein.

The cylindrical block 2 has a central chamber 20 extended axially from a first end (the lower end in FIG. 5) to a second end thereof. The cylindrical block 2 has an annular channel 211 and two grooves located respectively at both sides of the annular channel 211 on an outer surface thereof. A seal ring 22 is disposed in each groove. At least one air hole 23 is defined through an underside of the annular channel 211, which communicates with the central chamber 20. An inner surface of the central chamber 20 is provided with an appropriate length of screw threads extended from the first end toward the second end thereof. A connection hole 24 may be defined through an end surface of the second end of the central chamber 20, and a pressure gauge 21 may be provided at the second end of the cylindrical block 2. The connection hole 24 can be functioned as a connection passage between the pressure gauge 21 and the central chamber 20. The cylindrical block 2 is pivotably fitted in the central hole 111 of the head 11, and the annular channel 211 faces to the air inlet 15 of the head 11 whenever the cylindrical block 2 rotates in a range of 360 degrees in the central hole 111. The seal rings 22 at the both sides of the annular channel 211 prevent the air in the annular channel 211 from leakage out of the central hole 111.

The fixing seat 3 in accordance with a preferred embodiment of the present invention includes a stub tube 31 protruded from an outer surface of the fixing seat 3 with an appropriate length. The stub tube 31 has an axially-extended through hole 311. The stub tube 31 has external screw threads engaging with the inner screw threads of the central chamber 20. The fixing seat 3 has a side hole 30 and an axle hole 33 at both ends thereof, respectively, which communicate with the through hole 311. An inner surface of the side hole 30 also has inner screw threads. In assembling, a seal ring 32 sleeves around a root of the stub tube 31, and the stub tube 31 is screwed into the central chamber 20 of the cylindrical block 2 and presses against the seal ring 32 to prevent the air in the central chamber 20 from leakage out of a gap between the central chamber 20 and the stub tube 31.

The axle hole 33 of the fixing seat 3 is disposed with a pressure-releasing device 4 for releasing an overpressure. Preferably, the pressure-releasing device 4 comprises an axle pin 40 having a radially discharging hole 401 and a flange 402 disposed at a second end of the axle pin 40. When assembling the axle pin 40 to the fixing seat 3, the axle pin 40 sleeves with a seal ring 43 biasing against the flange 402, and a first end of the axle pin 40 is inserted through the side hole 30 and loosely fitted into the axle hole 33 of the fixing seat 3. The first end of the axle pin 40 passes through the axle hole and is mounted with a button 44. A spring 5 is provided at the second end of the axle pin 40.

The air delivery tube 6 in accordance with the present invention at a first end has a joint 61 having a ventilating hole 611, and at a second end has an inflating nozzle 62 (see FIGS. 1 and 2). The outer surface of the joint 61 has external screw threads, whereby the joint 61 can be locked into the side hole 30 of the fixing seat 3 and retains against the spring 5. The elastic force of the spring 5 pushes the flange 402 of the axle pin 40 to bias against the seal ring 43, so as to prevent the air from leakage out of a gap between the axle pin 40 and the axle hole 33 and move the discharging hole 401 toward the first end of the axle pin 40 and across the seal ring 43.

Referring to FIG. 5, the air delivery tube 6 is engaged with the fixing seat 3 and the fixing seat 3 is tightly locked to the cylindrical block 2. Since the cylindrical block 2 can rotate 360 degrees in the central hole 111 of the head 11, the fixing seat 3 together with the air delivery tube 6 can also rotate 360 degrees with the cylindrical block 2. When a user operates the air pump, compressed air produced by the pump 1 goes into the annular channel 211 of the cylindrical block 2 via the air inlet 15, and then in turn passes through the air hole 23 and the central chamber 20 of the cylindrical block 2, the through hole 311 of the stub tube 31, the ventilating hole 611 of the joint 61, the air delivery tube 6, and the inflating nozzle 62 into an object to be inflated. When the pressure in the inflated object is too high, the user can push the button 44 to move the discharging hole 401 toward the second end of the axle pin 40 and across the seal ring 43, thus the air in the inflated object can be discharged via the discharging hole 401. After the pressure in the inflated object is reduced to a desired level, the button 44 is released and the flange 402 of the axle pin 40 again biases against the seal ring 43 due to the action of the spring 5 to avoid air release.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A universal air pumps, comprising:

a head having a central hole and an air inlet at a side wall of the head, which communicates with the central hole;

a pump mounted to the side wall of the head, wherein a one-way valve facing to the air inlet of the head is disposed between the pump and the head;

a cylindrical block having a central chamber extended axially from a first end to a second end thereof, wherein the cylindrical block has an annular channel and seal rings disposed at both sides of the annular channel on an outer surface thereof, at least one air hole is defined through an underside of the annular channel, which communicates with the central chamber, the cylindrical block is pivotably fitted in the central hole of the head and the annular channel faces to the air inlet of the head;

a fixing seat having a stub tube, which is protruded from an outer surface of the fixing seat and engaged with the central chamber of the cylindrical block and has an axially-extended through hole communicating with the central chamber; the fixing seat having a side hole provided at a side wall thereof, which communicates with the axially-extended through hole; and an air delivery tube, a first end of which is provided with a joint mounted to the side hole of the fixing seat, and a second end of which is provided with an inflating nozzle, wherein the head and the fixing seat can freely rotate relative to each other, and wherein the air delivery tube is directly mounted to the fixing seat.

2. The universal air pump as claimed in claim 1, wherein a pressure gauge is disposed at the second end of the cylindrical block, and a connection hole is defined through an end surface of the central chamber and communicates the central chamber with the pressure gauge.

3. The universal air pump as claimed in claim 1, wherein an axle hole is defined through another side wall of the fixing seat, which faces to the side hole, and a pressure-releasing device is disposed in the axle hole.

4. The universal air pump as claimed in claim 2, wherein an axle hole is defined through another side wall of the fixing seat, which faces to the side hole, and a pressure-releasing device is disposed in the axle hole.

5. The universal air pump as claimed in claim 3, wherein the pressure-releasing device comprises an axle pin having a radially discharging hole and a flange disposed at a second end of the axle pin, the axle pin is loosely fitted into the axle hole of the fixing seat, a first end of the axle pin passes through the axle hole, a spring is provided between the second end of the axle pin and the joint, an end of the axle hole is provided with a seal ring, and the flange closely biases against the seal ring due to the action of the spring.

6. The universal air pump as claimed in claim 4, wherein the pressure-releasing device comprises an axle pin having a radially discharging hole and a flange disposed at a second end of the axle pin, the axle pin is loosely fitted into the axle hole of the fixing seat, a first end of the axle pin passes through the axle hole, a spring is provided between the second end of the axle pin and the joint, an end of the axle hole is provided with a seal ring, and the flange closely biases against the seal ring due to the action of the spring.

7. The universal air pump as claimed in claim 5, wherein the first end of the axle pin is mounted with a button.

8. The universal air pump as claimed in claim 6, wherein the first end of the axle pin is mounted with a button.

9. The universal air pump as claimed in claim 1, wherein the central chamber of the cylindrical block has inner screw threads, and an outer surface of the stub tube has external screw threads engaging with the inner screw threads of the central chamber.

* * * * *

UNITED STATES PATENT AND TRADEMARK OFFICE

CERTIFICATE OF CORRECTION

PATENT NO. : 7,661,934 B2
APPLICATION NO. : 11/512142
DATED : February 16, 2010
INVENTOR(S) : Ying-Che Huang It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 757 days.

Signed and Sealed this

Thirtieth Day of November, 2010

David J. Kappos

David J. Kappos
*Director of the United States Patent and Trademark Office*